US005661852A

United States Patent [19]

Kessler

[11] Patent Number: 5,661,852

[45] Date of Patent: Sep. 2, 1997

[54] ORTHOPEDIC SURGICAL SHIRT

[76] Inventor: Nia M. Kessler, 2709 NE. 30th St., Ft. Lauderdale, Fla. 33306

[21] Appl. No.: 625,239

[22] Filed: Apr. 1, 1996

Related U.S. Application Data

[63] Continuation of Ser. No. 304,941, Sep. 13, 1994.

[51] Int. Cl.[6] ..... A41B 1/00

[52] U.S. Cl. ..... 2/114; 2/106; 2/912; 2/913; 602/24

[58] Field of Search ..... 2/46, 69, 69.5, 2/75, 80, 83, 104, 105, 106, 113, 114, 115; 602/19, 24

[56] References Cited

U.S. PATENT DOCUMENTS

| | | | |
|---|---|---|---|
| 2,504,534 | 4/1950 | Kephart et al. | 2/114 |
| 4,055,855 | 11/1977 | Ragone et al. | 2/114 |
| 4,644,590 | 2/1987 | Pincham | 2/115 |
| 4,668,564 | 5/1987 | Bogart et al. | 2/115 |
| 4,686,714 | 8/1987 | Harley | 2/114 |
| 4,764,986 | 8/1988 | Stewart | 2/115 |
| 4,964,173 | 10/1990 | Gordon et al. | 2/114 |
| 5,033,461 | 7/1991 | Young et al. | 128/88 |
| 5,274,852 | 1/1994 | Hogan | 2/114 |

OTHER PUBLICATIONS

Gershman, Maurice, "Self Adhering Nylon Tapes," The J.A.M.A., vol. 168, No. 7, p. 930, Oct. 1958.

*Primary Examiner*—Jeanette E. Chapman

*Attorney, Agent, or Firm*—Lackenbach Siegel Marzullo Aronson & Greenspan, P.C.

[57] ABSTRACT

An orthopedic shirt used by a patient during a post-operative stage of a repair procedure or treatment involving a patient's shoulder, arm or upper body region, and used with an upper body immobilization device such as an abduction pillow, brace, cast, splint, and the like. The orthopedic shirt consists of a first panel and a second panel that are substantially cut so that either panel may serve as a front or a rear of the shirt. Each panel consists of an outer edge. Each panel further defines a sleeve portion also containing the outer edge. Releasable fasteners are disposed along at least one outer edge of the panels, and sleeve portions of the panels. These fasteners releasably interconnect the two panels, and segments of the sleeves. This releasable interconnection of the panels, and sleeves allows the patient to be dressed or undressed without involving the movement of an immobilized shoulder, an upper body region that has undergone trauma, or an upper body region that has undergone treatment. The orthopedic shirt further consists of a first panel and a second panel that are substantially cut so that either panel may serve as a front or a rear of the shirt.

4 Claims, 3 Drawing Sheets

ORTHOPEDIC SURGICAL SHIRT

This application is a continuation, of application Ser. No. 08/304,941, filed Sep. 13, 1994.

BACKGROUND OF THE INVENTION

This invention relates to an orthopedic surgical shirt for use by a patient; and, more particularly, it relates to an orthopedic shirt for use by a patient who has undergone treatment for an injury, or shoulder surgery that requires post-operative stabilization of the treated shoulder. As is well known, after sustaining an injury, receiving treatment, or undergoing an operation on a shoulder, an arm, other upper body region, a patient is frequently required to wear a hospital gown during a period of recovery. Patients are also frequently required to wear a brace, an abduction pillow, a sling, or a cast to allow an affected upper body region to heal properly. Abduction pillows, braces, casts, slings and other immobilization devices are frequently used after surgery, and are generally referred to herein as upper body immobilization devices.

Hospital gowns generally have openings located on the front, top, or rear of the gown, and utilize ties to secure the gown. A major problem associated with this type of gown is that a patient must maneuver his affected upper body region and/or an upper body immobilization device to pass through a narrow opening in the sleeve of the gown. The necessity of maneuvering the patient's affected upper body region, and/or upper body immobilization device through the sleeve of the hospital gown can result in pain and discomfort to the patient, and can even severely disturb the affected region. The only other alternative is for a patient to tear the side portion of a hospital gown in such a way as to accommodate an upper body immobilization device.

A similar problem results during the latter stages of a post-operative period, e.g. once a patient is outside the hospital. By way of example, a patient who has undergone rotator cuff repair surgery, a shoulder stabilization procedure, or who has had an upper body injury, frequently needs to remove clothing to examine the affected area, to bathe, to dress, or to undress. However, the clothing must generally be removed while wearing an upper body immobilization device. This procedure can cause the patient discomfort since the immobilized body region must frequently be contorted to fit into standard types of garments. Moreover, these immobilization devices often prevent the patient from wearing aesthetically pleasing garments, by way of example, a T-shirt or dress shirt, without risking discomfort, or disruption of a surgical repair. Consequently, a side of a shirt, or similar garment, is frequently torn open to allow for the patient to accommodate the upper body immobilization device, and to allow for the patient to dress or undress.

There are a number of gowns, vests, and other garments known in the art. These devices either immobilize an injured, treated, or surgically corrected area, or simply serve to clothe the patient. These devices frequently feature fasteners located on the top portion of sleeves, and on the front or rear of gowns. A shortcoming of these garments and devices is that they do not accommodate an upper body immobilization device, serve to aesthetically clothe the patient, allow the patient to dress with minimal maneuvering of, or discomfort to an affected body region. Examples of such garments and devices may be found in U.S. Pat. Nos. 4,422,186, 4,570,268, 4,787,101, 4,920,578, 5,007,412.

It would be highly desirable to solve the variety of problems enumerated above facing a patient who has undergone rotator cuff repair surgery, a shoulder stabilization treatment, who has an upper body injury, and who requires clothing that will accommodate a upper body immobilization device.

The present invention targets the thousands of patients who undergo orthopedic shoulder surgery worldwide, and serves this market by providing an aesthetically pleasing orthopedic surgical shirt that accommodates a upper body immobilization device and allows a patient to dress with minimal discomfort or movement of an immobilized body region, thereby, decreasing the risk that a patient will disrupt a surgical repair in an attempt to get dressed and undressed.

SUMMARY OF THE INVENTION

These and other objects of the present invention are achieved in an orthopedic shirt that is used by a patient during a post-operative stage of a repair procedure or treatment involving a patient's shoulder or upper body, and is used with a quadrant brace, an abduction pillow, a sling, a cast, or other upper body immobilization device.

The present invention provides an orthopedic shirt that allows for the patient to be dressed without disturbing a shoulder, arm or other upper body area that has sustained an injury, undergone an operation or treatment, includes a neck opening of a size and shape to allow the patient's head and neck to pass, includes sleeves that accommodate an upper body immobilization device and a patient's extremities.

In one embodiment, the present invention provides an orthopedic shirt consisting of a first panel and a second panel that are substantially cut so that either panel may serve as a front or a rear of the shirt. Each panel consists of an outer edge. Each panel further defines a sleeve portion also containing an outer edge. Releasable fasteners are disposed along at least one outer edge of the panels and sleeve portions of the panels. These fasteners releasably interconnect the two panels, and segments of the sleeves. This releasable interconnection of the panels, and sleeves allows the patient to be dressed or undressed without involving the movement of an immobilized shoulder. In yet another embodiment, the present invention provides an orthopedic shirt that is reversible.

It is an object of the invention to provide a method for facilitating the dressing of a patient in an orthopedic shirt without disturbing the patient's shoulder. The method includes the steps of placing a patient's head and neck through an opening in the shirt; positioning the shirt having an open seam disposed on an outer edge of two panels of the shirt over an arm adjacent to an affected upper body region; positioning the shirt over an upper body immobilization device; and, closing the open seam of the shirt using fasteners disposed on the end regions of the outer edge of the panels. These and other objects will become apparent in the course of a detailed description of the invention.

DETAILED DESCRIPTION OF THE INVENTION

Figure 1:
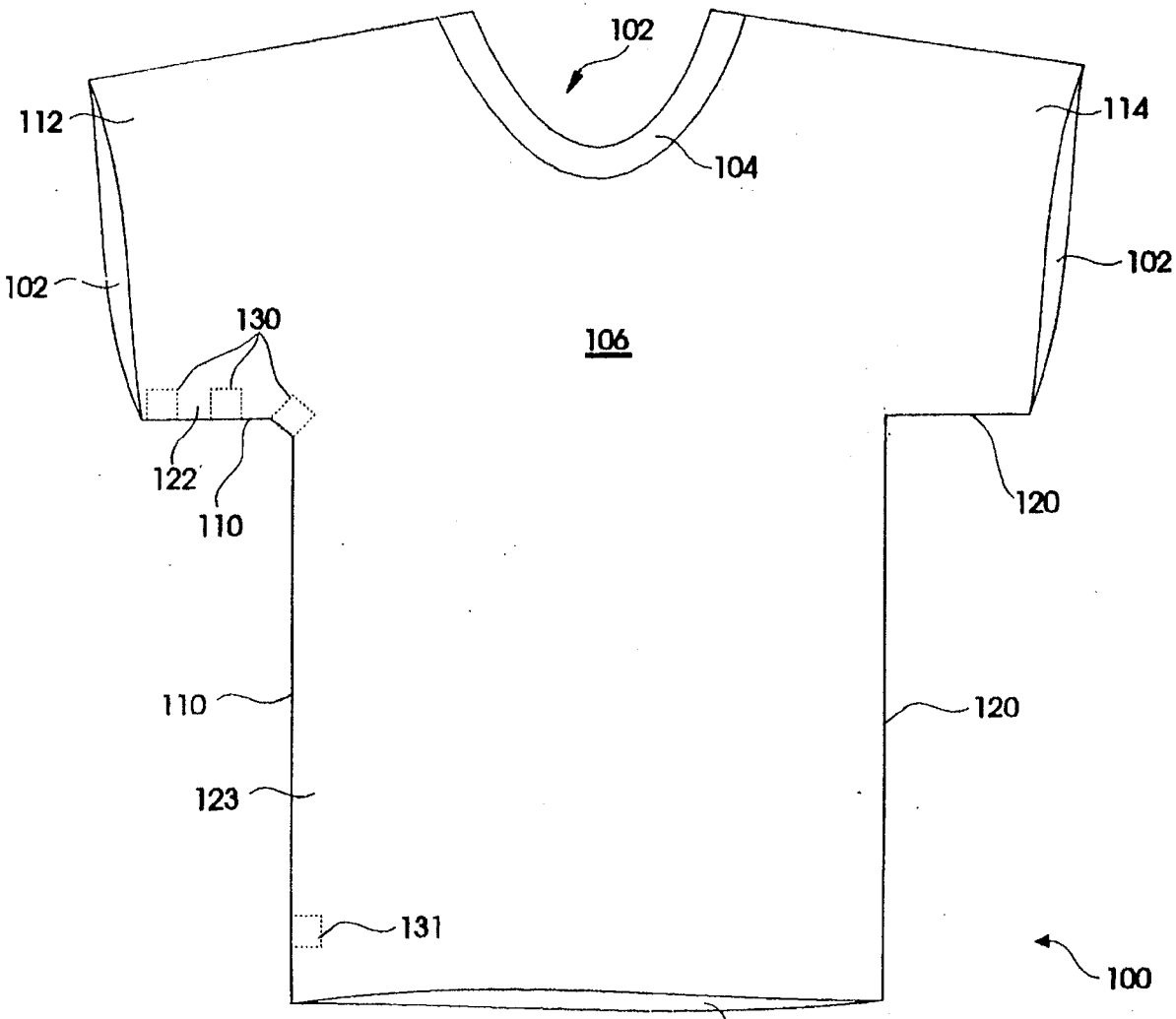
FIG. 1 is a front view of an orthopedic shirt with a releasably interconnected outer edge of two panels of the shirt in closed position.

FIG. 1 is a front view of orthopedic shirt 100. Orthopedic shirt 100, as viewed in FIGS. 1, 2, and 3 consists of a neck opening 102. Neck opening 102 is of a size and shape to allow for a patient's head and neck to pass through the opening. In a preferred embodiment, neck opening 102 is encircled by collar 104. Shirt 100 contains a first panel 106 and a second panel 108. In one embodiment, panels 106 and 108 are cut so that they are substantially identical mirror images of each other. It will be appreciated that this overall configuration of panels 106 and 108 allows for either panel 106 or panel 108 to serve as a front or rear of shirt 100. This feature allows for right or left upper body usage and permits the garment to be reversible.

Figure 2:
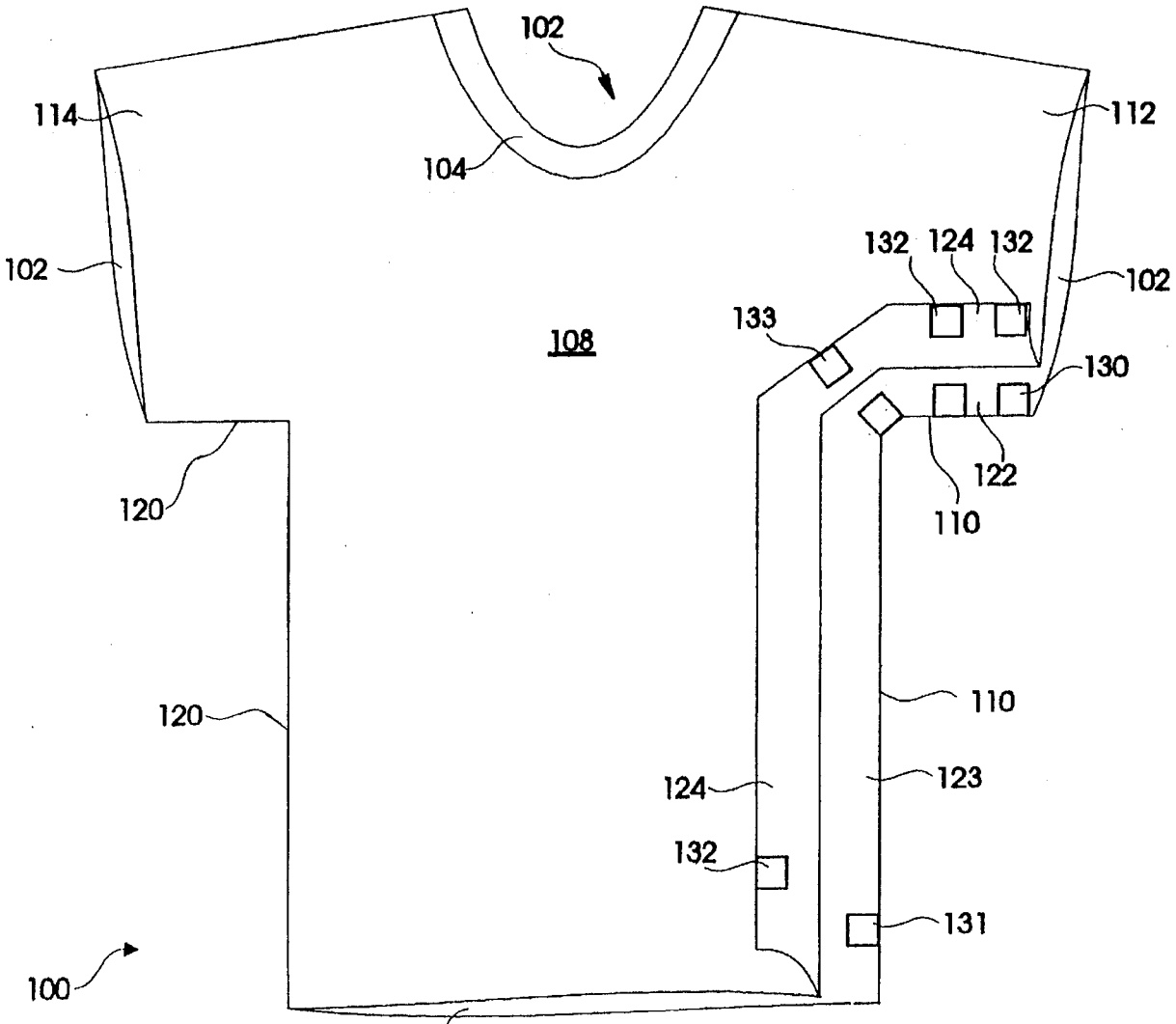
FIG. 2 is a front view of the opposite side of the orthopedic shirt of FIG. 1, a panel toward the viewer being folded back to disclose fasteners.
Figure 3:
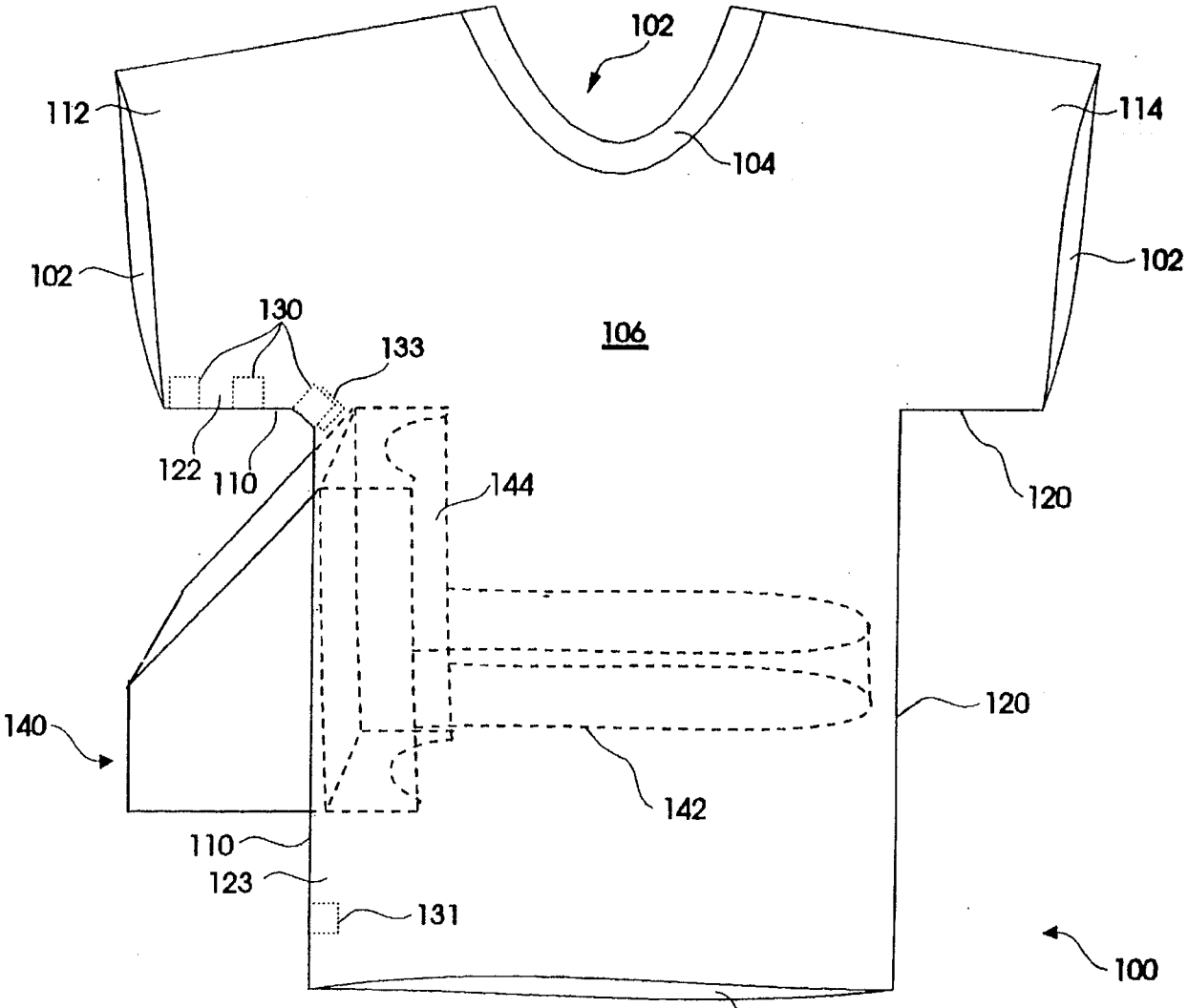
FIG. 3 is a perspective view of the shirt of FIG. 1 with the addition of an exemplary upper body immobilization device, namely, an abduction pillow.

As viewed in FIGS. 1, 2, and 3 panels 106 and 108 define sleeve portions 112, 114. Sleeve portions 112, 114 contain openings 102 which accommodate a patient's arms.

While these embodiments describe sleeves 112, 114 having openings 102 of a substantially similar size and shape, the present invention contemplates that sleeve 112 may contain an opening 102 that is larger or smaller than opening 102 in sleeve 114. Openings 102 are of a size and shape to accommodate a patient's arm and/or braces, casts, splints, bandages, and other devices used to immobilize a patient's shoulder, arm, and or upper body.

As viewed in FIGS. 1, 2, and 3, outer edge 110 is formed by a first end region consisting of end regions 122, 123 defined on panel 106. Similarly, panel 108 includes a second end region 124 as viewed in FIG. 2. In a preferred embodiment, hook fasteners 130,130, 130 (approximately 1.25 inches in length by 1.0 inch in width) are mounted on end region 122. Corresponding loop fasteners 132, 132, 133 are mounted on end region 122 (FIG. 2). Hook fastener 131 is mounted on end region 123 approximately three inches from the bottom of edge 108. Corresponding loop fastener 132 is mounted on end region 124 approximately three inches from the bottom of edge 108. The distance from fastener 131 to fastener 130 is approximately 12 inches. Hook and loop fasteners 130, 131, 132, 133 are used to releasably secure and interconnect end region 123 to end region 124, and end region 124 to end region 122, respectively. In one embodiment, Velcro brand hook and loop fasteners available from Velcro USA, Inc., 406 Brown Avenue, Manchester, N.H. 03108 are utilized.

It will be appreciated that in this embodiment drainage tubes and other medical apparatus can be connected to the patient along edge 110 through spaces formed in end regions 122, 123, 124, between adjacent fasteners, while allowing for shirt 100 to remain closed. In yet another embodiment fasteners 130, 132 form a continuous fastening strip along the length of edge 110. The present invention further contemplates the use of other types of fasteners that include by way of example snaps, hooks, ties, zippers, and the like.

Outer edge 110 of panels 106, 108 and sleeve portion 112 is capable of being opened and closed by pulling apart or pressing together fasteners 130, 131, 132, 133 positioned along end regions 122, 123, 124. As shown in FIG. 2, an open seam is created along opening 102 on sleeve 112 and edge 110 when fasteners 130, 131, 132, 133 are in an open position. The open seam allows for a patient to get dressed or undressed without involving the movement of the patient's immobilized shoulder.

More specifically, a patient who has undergone a shoulder repair procedure, or shoulder treatment is frequently required to be dressed or undressed without disturbing the treated shoulder. To keep the treated shoulder from being disturbed, the shoulder is immobilized by placing the it in a upper body immobilization device. Many upper body immobilization devices are known in the art and include vests, braces, splints, abduction pillows, casts, and the like. FIG. 3 illustrates an exemplary upper body immobilization device, abduction pillow 140. As is well known, inner portion 144 of abduction pillow 140 rests against the side of the patient's torso. Belt 142 secures abduction pillow 140 to the patient. The patient's arm may then be secured to a surface of pillow 140 to keep the arm and shoulder stabilized.

Abduction pillow 140 and shirt 100 are used in combination for facilitating the dressing or undressing of a patient who has undergone a shoulder repair procedure or treatment. A method for facilitating the dressing or undressing a patient comprises the following steps: the patient's head and neck is placed through opening 102 in shirt 100; Shirt 100 is positioned over the patient's arm opposite the affected shoulder, arm or other upper body region; shirt 100 is positioned over the patient's arm adjacent to the shoulder or other upper body region having undergone repair surgery, treatment or trauma via an open seam; the open seam is formed along edge 110 from opening 102 of sleeve 112, and from edge 110 when fasteners 130, 131, 132, 133 are disengaged (FIG. 2); and, the open seam is closed by pressing together fasteners 130, 131, 132, 133 along end regions 122, 123.

In another embodiment, fasteners 130, 131, 132, 133 are disposed along edge 120 in a manner similar to their disposition along edge 110. In this embodiment, releasable fasteners 130, 131, 132, 133 allow access to both the right and left sides of shirt 100 along edges 110, 120. It will be appreciated that this embodiment will greatly benefit a patient who has experienced trauma on both a right and left upper body region, when surgery on an upper body region has been performed, and/or if both right and left upper body regions require immobilization.

It will be further appreciated that this method of dressing a patient allows for the patient to be dressed and undressed easily and decreases the risk the patient may disturb the treated shoulder. Moreover, shirt 100 provides an aesthetically pleasing alternative to garments that must be torn to accommodate an upper body immobilization device, or garments that would be inappropriate to wear outside of a hospital environment, e.g. hospital gowns.

In a preferred embodiment, panels 106, 108 are sewn together to form edge 120. Further, the top edges of panels 106, 108 are sewn to form the top portions of sleeves 112, 114. In yet another embodiment, panels 106, 108 and the top edges of sleeves 112, 114 consist of a single continuous piece of fabric wherein outer edge 120 constitutes the section of the single piece of fabric interconnecting panels 106, 108. The present invention also contemplates that, as viewed in FIGS. 2 and 3, the area between panels 106, 108 and between fastener 133 and fastener 131 (both in a closed position with their corresponding fasteners) is of a size and shape to accommodate abduction pillow 140, or other upper body immobilization device. In yet a further embodiment, the size and shape of this area is such that belt 142 (FIG. 3) is accommodated.

While only a few, preferred embodiments of the invention have been described hereinabove, those of ordinary skill in the art will recognize that the embodiment may be modified and altered without departing from the central spirit and scope of the invention. Thus, the preferred embodiment described hereinabove is to be considered in all respects as illustrative and not restrictive, the scope of the invention being indicated by the appended claims, rather than by the foregoing description, and all changes which come within the meaning and range of equivalency of the claims are intended to be embraced herein.

I claim:

1. An orthopedic apparatus comprising in combination a garment and an upper limb immobilization appliance comprising, said garment having a continuous matable fastening device along one of said outer edges;

said first panel free of slits;

said second panel free of slits;

said upper limb immobilization appliance attached to a patient, and permitting said patient free movement of the patient's head;

a sleeve portion defined on said first and second panels;

at least said first outer edges of said first and second panels being releasably interconnected by said continuous matable fastening device disposed along each of said first and second panels to create an opening, for said upper limb immobilization appliance, between said panels of infinitely variable vertical and horizontal size to accommodate a wide variety of differently configured upper limb immobilization appliances for immobilizing said upper limb while permitting free movement of said patient's head; and said opening, forming an open seam for clearance of a least said upper limb immobilization appliance, and said opening being of sufficient size and shape to accommodate an upper limb of the patient and said immobilization appliance, as well as a least one other therapeutic apparatus including cast, brace, abduction pillow, drainage tube, sling connectable to said patient, and a belt for securing said immobilization appliance upon fastening together said continuous matable fastening device along one of said outer edges of said first and second panels.

2. The orthopedic garment of claim 1 wherein said continuous mateable fastening device comprises at least one elongated hook and loop fastener.

3. The orthopedic apparatus of claim 1 wherein said upper body immobilization appliance is selected from the group consisting of a quadrant brace and an abduction pillow.

4. The orthopedic apparatus of claim 1 in which said second outer edges are formed from a continuous piece of fabric.

* * * * *